US012680705B2

(12) United States Patent
Magill et al.

(10) Patent No.: US 12,680,705 B2
(45) Date of Patent: Jul. 14, 2026

(54) COLLAPSIBLE HOOD

(71) Applicant: Nortek Air Solutions, LLC, O'Fallon, MO (US)

(72) Inventors: Lee Aaron Magill, Mustang, OK (US); Terry Ray Leatham, Oklahoma City, OK (US)

(73) Assignee: Nortek Air Solutions, LLC, Okarche, OK (US)

( * ) Notice: Subject to any disclaimer, the term of this patent is extended or adjusted under 35 U.S.C. 154(b) by 0 days.

(21) Appl. No.: 18/793,429

(22) Filed: Aug. 2, 2024

(65) Prior Publication Data

US 2025/0043968 A1 Feb. 6, 2025

Related U.S. Application Data

(60) Provisional application No. 63/530,803, filed on Aug. 4, 2023.

(51) Int. Cl.
*F24F 1/56* (2011.01)

(52) U.S. Cl.
CPC ..... *F24F 1/56* (2013.01)

(58) Field of Classification Search
CPC .... F24F 1/56; F24F 13/20; F24F 13/08; F24F 2221/52; F24F 2221/36; F24F 13/084; F24F 13/085; F24F 1/58; F24F 2221/12
See application file for complete search history.

(56) References Cited

U.S. PATENT DOCUMENTS 1,022,870 A * 4/1912 Power ..... E06B 7/26 D23/370
2,557,676 A * 6/1951 Miller ..... E04F 10/10 160/183
2005/0003751 A1* 1/2005 Thomas ..... B60H 1/00364 454/136
2019/0383514 A1* 12/2019 Nanjappa ..... F24F 13/084
2021/0332991 A1* 10/2021 Singh ..... F24F 1/58
2024/0210046 A1* 6/2024 Singh ..... F24F 13/28

* cited by examiner

*Primary Examiner* — J. T. Newton

(74) *Attorney, Agent, or Firm* — Schwegman Lundberg & Woessner, P.A.

(57) ABSTRACT

An air handling unit (AHU) includes a cabinet and a collapsible hood. One or more components of the AHU are arranged in the cabinet, which defines at least one air vent. The collapsible hood includes a cap plate, base bracket, hood plate, and pair of side plates. The cap plate is fixedly connected to the cabinet above the at least one air vent. The base bracket is fixedly connected to the cabinet below the cap plate. The hood plate is pivotally connected to the cap plate. Each of the pair of side plates is pivotally connected to the cap plate and the base bracket.

9 Claims, 7 Drawing Sheets

COLLAPSIBLE HOOD

CLAIM OF PRIORITY

This patent application claims the benefit of U.S. Provisional Patent Application No. 63/530,803, filed Aug. 4, 2023, entitled "COLLAPSIBLE HOOD", which is incorporated by reference herein in its entirety.

BACKGROUND

Heating, ventilation, and air conditioning (HVAC) systems are commonly mounted on the outside of a structure in a cabinet or housing of some kind. Air handling units (AHUs), for example, are sometimes mounted on the roof in a large cabinet in which various elements of the AHU are arranged. AHUs also commonly include air vents through which air is transmitted into and/or out of the AHU. To prevent water infiltration into the AHU, e.g. in the event of rain, AHUs often include rain hoods that shroud the air vents from the rain while still allowing air to flow through vents.

Some AHUs or other HVAC systems are relatively large and the cost to ship them to a site and then install them, e.g., on the roof of a building can be significant. Current rain hoods are commonly designed as a separate, non-collapsible component from the AHU or other system for which it is used and, as such, must be shipped separately from the AHU cabinet due to their size and truck shipping width constraints. Such rain hoods can add to the expense of shipping the system, as they may add to the weight-based cost and/or require additional trailers. Additionally, such current, non-collapsible rain hoods not incorporated into the system cabinet must be installed on the cabinet in the field, which can require using cranes, forklifts, etc. to lift into place safely before being secured to the cabinet.

SUMMARY

The present inventors recognize, among other things, an opportunity for improving the packaging, shipping, and installation of various types of HVAC systems by incorporating collapsible rain hood(s) into the system cabinet, which can be shipped with the system cabinet in a collapsed configuration and then be easily and inexpensively expanded into a working configuration on site.

In an example according to this disclosure, an air handling unit (AHU) includes a cabinet and a collapsible hood. One or more components of the AHU are arranged in the cabinet, which defines at least one air vent. The collapsible hood includes a cap plate, base bracket, hood plate, and pair of side plates. The cap plate is fixedly connected to the cabinet above the at least one air vent. The base bracket is fixedly connected to the cabinet below the cap plate. The hood plate is pivotally connected to the cap plate. Each of the pair of side plates is pivotally connected to the cap plate and the base bracket. The collapsible hood can be configured to be arranged in a working configuration in which the hood plate and the pair of side plates extend away from the cap plate and the base bracket and are configured to inhibit ingress of materials other than air through the at least one air vent, and a collapsed configuration in which the hood plate and the pair of side plates are folded in a flat stacked arrangement toward the cabinet and over the at least one air vent.

This overview is intended to provide an overview of subject matter in the present application. It is not intended to provide an exclusive or exhaustive explanation of the invention. The detailed description is included to provide further information about the present application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present disclosure.

DETAILED DESCRIPTION

Figure 1:
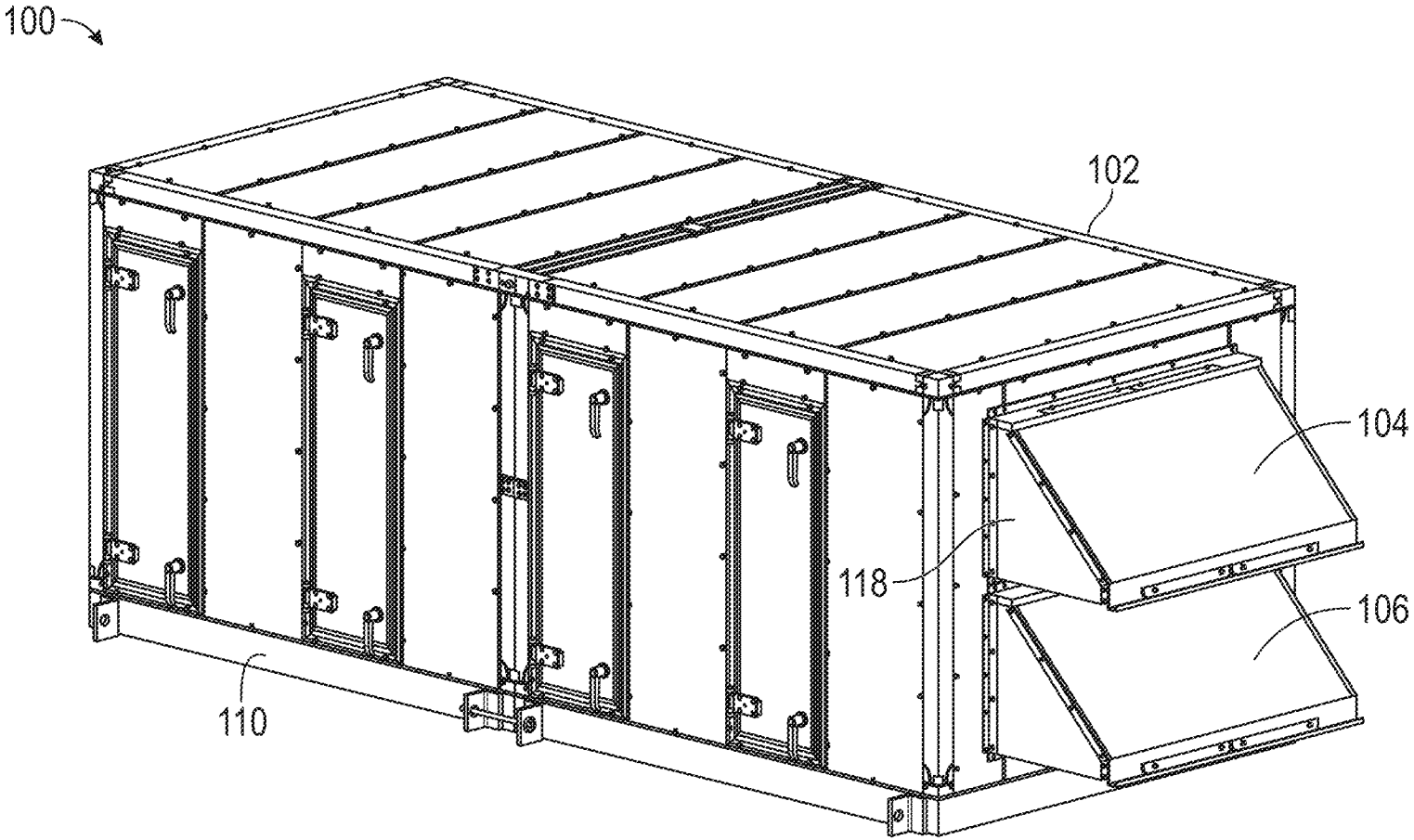
FIG. 1 is a perspective of an example AHU including a system cabinet with a pair of collapsible rain hoods.

FIG. 1 is a perspective of example AHU 100 including system cabinet 102 with a pair of collapsible rain hoods 104, 106. As will be described in more detail with reference to the following figures, rain hoods 104 and 106 are configured to be shipped with system cabinet 101 in a collapsed configuration and then be expanded into a working configuration on site. Rain hoods 104 and 106 are depicted in FIG. 1 in a working, expanded configuration and are coupled to system cabinet adjacent respective air vents (not shown). Hoods 104 and 106 are configured in the working configuration to limit or eliminate ingress of rain and other materials into the air vents of AHU 100. Although AHU 100 includes two rain hoods 104 and 106, other example AHUs or other systems in accordance with this disclosure can include more or fewer collapsible hoods, generally corresponding to the number of air vents of the AHU/system. Collapsible rain hoods 104 and 106 and hoods in accordance with this disclosure can improve the packaging, shipping, and installation of various types of HVAC systems by incorporating collapsible rain hood(s) into the system cabinet, which can be shipped with the system cabinet in a collapsed configuration and then be easily and inexpensively expanded into a working configuration on site.

Figure 2A:
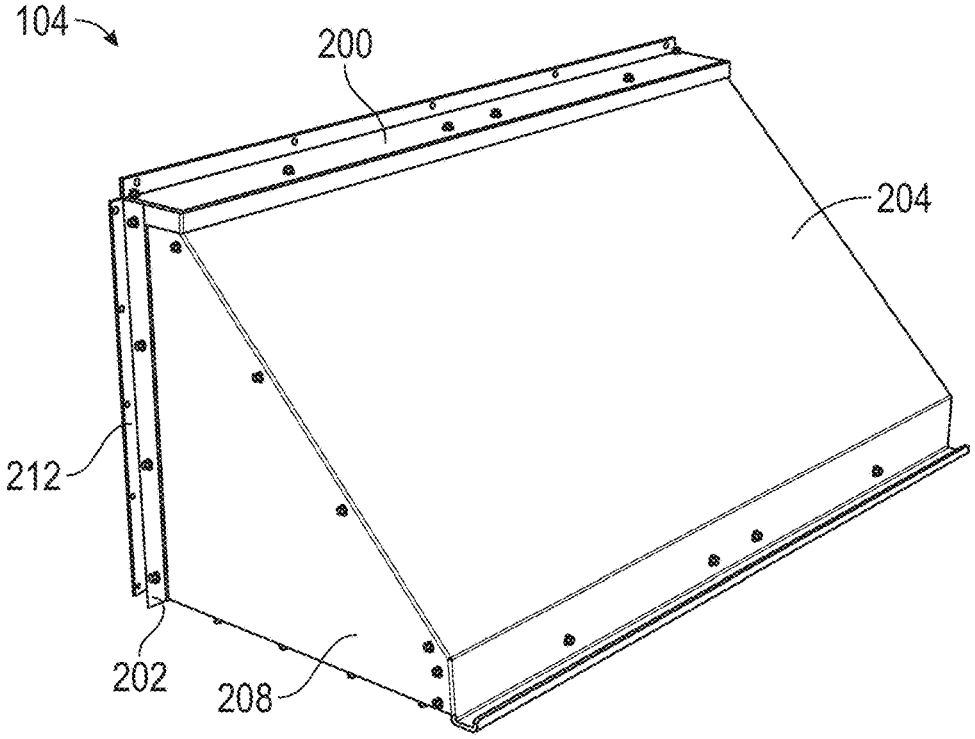
FIGS. 2A-2B are front and back perspective views the example collapsible rain hood of FIG. 1 deployed in a working configuration.
Figure 2B:
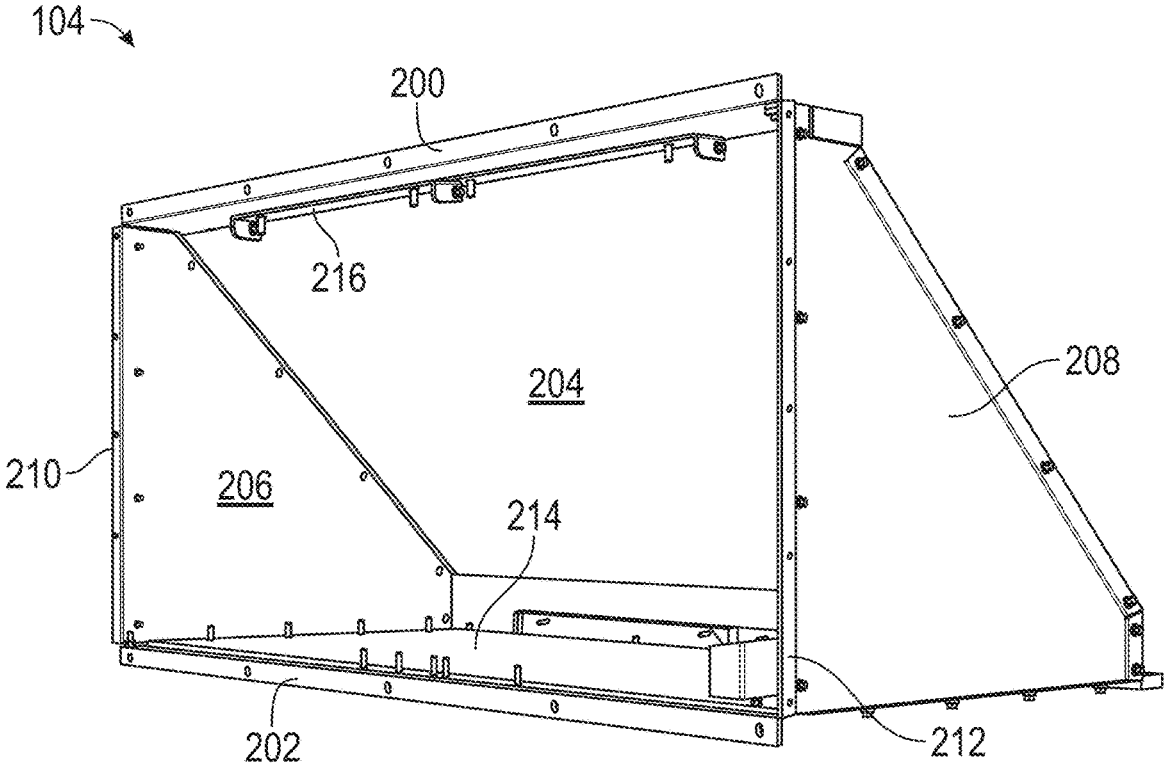

FIGS. 2A-2B are front and back perspective views example collapsible rain hood 104 of FIG. 1 deployed in a working configuration. Hood 104 is depicted in FIGS. 2A and 2B disconnected from any system cabinet. Hood 104 includes cap plate 200, base bracket 202, hood plate 204, side plates 206 and 208, side brackets 210 and 212, and screen 214. Cap plate 200 also includes hinge plate 216 fixedly connected to the cap plate.

Cap plate 200 is configured to be fixedly connected to the system cabinet (e.g., system cabinet 102 of FIG. 1) above at least one air vent. Base bracket 202 is also configured to be fixedly connected to the cabinet below cap plate 200. Hood plate 204 is pivotally connected to cap plate 200 via hinge plate 216 and each of side plates 206 and 208 are pivotally connected to cap plate 200 and base bracket 202. First side plate 206 is pivotally connected toward a first end of cap plate 200 and pivotally connected toward a first end of base bracket 202. Second side plate 208 is pivotally connected toward a second end of cap plate 200 opposite the first end of the cap plate and pivotally connected toward a second end of base bracket 202 opposite the first end of the base bracket. Screen 214 is pivotally connected to hood plate 204.

In FIGS. 2A-2B, example rain hood 104 is depicted in a working configuration in which it is configured to inhibit ingress of materials other than air through an air vent of an AHU or other HVAC cabinet to which it is connected. In this working configuration, hood plate 204 and side plates 206 and 208 extend away from cap plate 200 and base bracket 202. As depicted, for example, hood plate 204 is inclined to extend down and out from cap plate 200, and each of side plates 206 and 208 extends away from cap plate 200 and base bracket 202 to mate with hood plate 204. With the addition of screen 214, in the working configuration of FIGS. 2A-2B, hood plate 204 is inclined to extend down and out from cap plate 200, screen 214 extends from the extended end of hood plate 204 toward and is connected to base bracket 202, each of side plates 206 and 208 extends away from cap plate 200 and base bracket 202 to mate with hood plate 204 over screen 214. In the example of FIGS. 2A-2B, rain hood 104 includes side brackets 210 and 212, which each of which is configured to be connected to a system cabinet (e.g., cabinet 102 of FIG. 1) and one of side plates 206 and 208.

Each of cap plate 200, base bracket 202, hood plate 204, side plates 206 and 208, side brackets 210 and 212, and screen 214 can be manufactured from a variety of materials including, for example, various metals. In an example, each of cap plate 200, base bracket 202, hood plate 204, side plates 206 and 208, side brackets 210 and 212, and screen 214 are include sheet metal, e.g. galvanized steel with or without a coating of paint. Cap plate 200, base bracket 202, hood plate 204, side plates 206 and 208, side brackets 210 and 212, and screen 214 can be connected to each other and/or to a system cabinet using various types of fasteners, including screws, bolts, and rivets, as examples.

In an example, one or more of cap plate 200, base bracket 202, hood plate 204, side plates 206 and 208, side brackets 210 and 212, and screen 214 can be connected to one another using #12×1-inch self-drill screws. Pivotal/rotating connections between members of Hood 104 can utilize ¼ inch by ⅝-inch thread-locking button head bolts into a ¼ inch snap-in nuts. In an example, screen 214 includes a screen plate to which a screen is connected, and, in such a case, the screen can be attached to the screen plate with rivets. Additionally, connections to AHU 102 can be via ¼ inch self-drill screws.

FIGS. 3A-3D depict rain hood 104 transitioning from a collapsed configuration to a working configuration. In the completely collapsed configuration of FIG. 3A, side plates 206 and 208 are pivoted toward each other into approximately parallel alignment with cap plate 200 and base bracket 202. Hood plate 204 is pivoted down toward the system cabinet to which rain hood 104 is connected. Hood plate 204 is arranged in an approximately vertical orientation when folded down toward the cabinet. Screen 214 is pivoted up toward hood plate 204 into an approximately vertical arrangement between side plates 206 and 208 and hood plate 204.

Figure 3A:
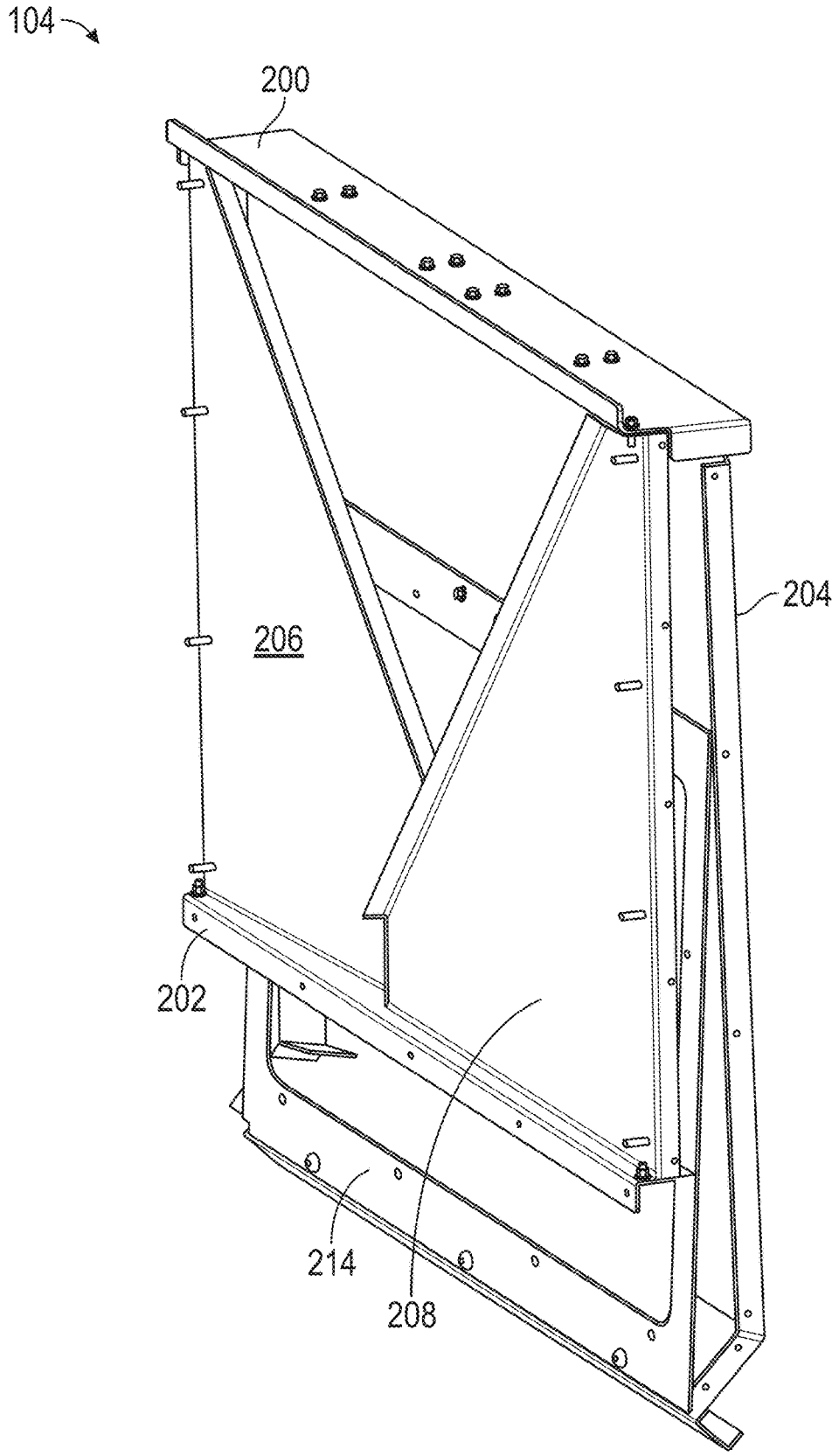
FIGS. 3A-3D are perspective views depicting an example collapsible rain hood as it is deployed from a collapsed configuration to a working configuration.
Figure 3B:
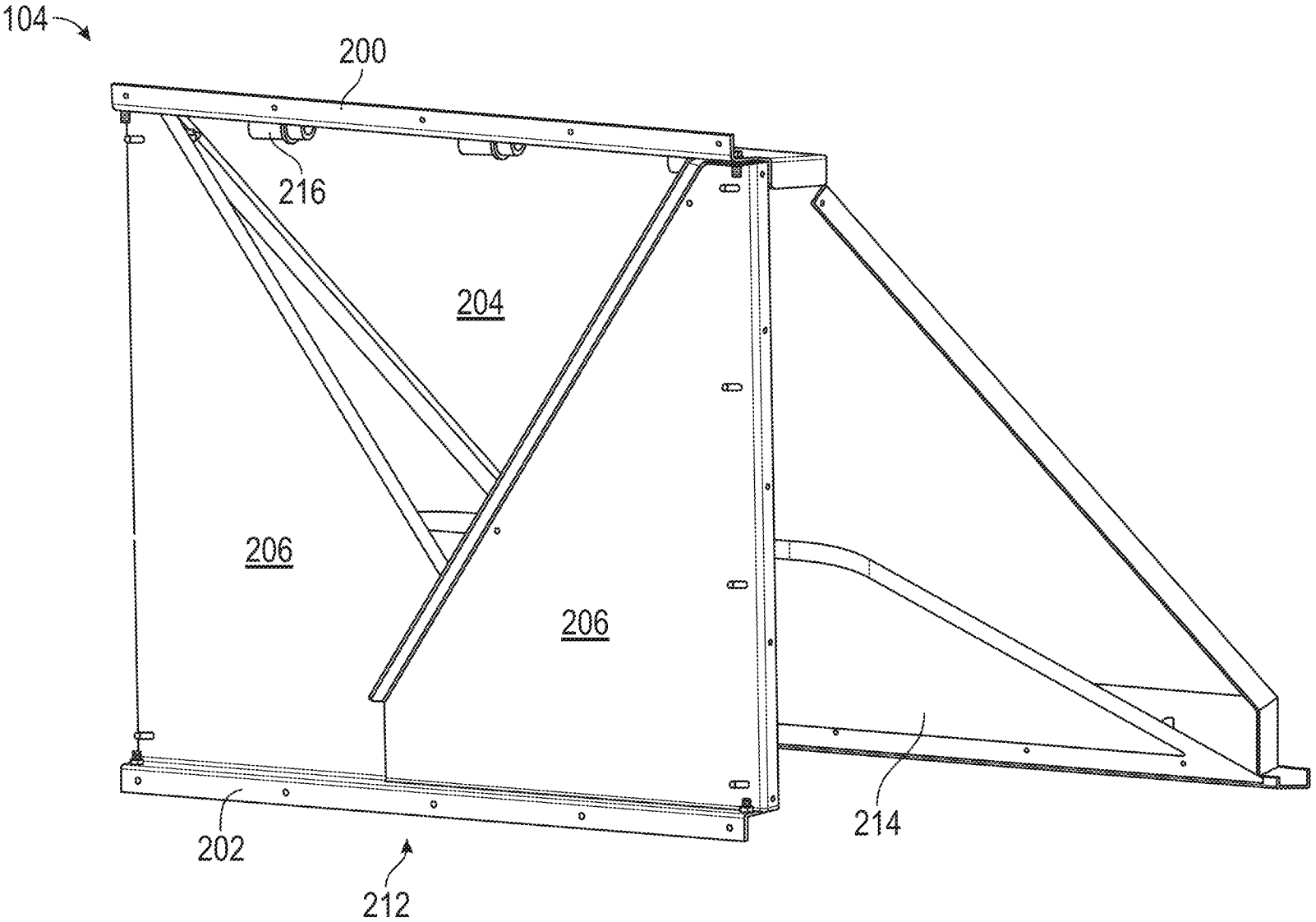
Figure 3C:
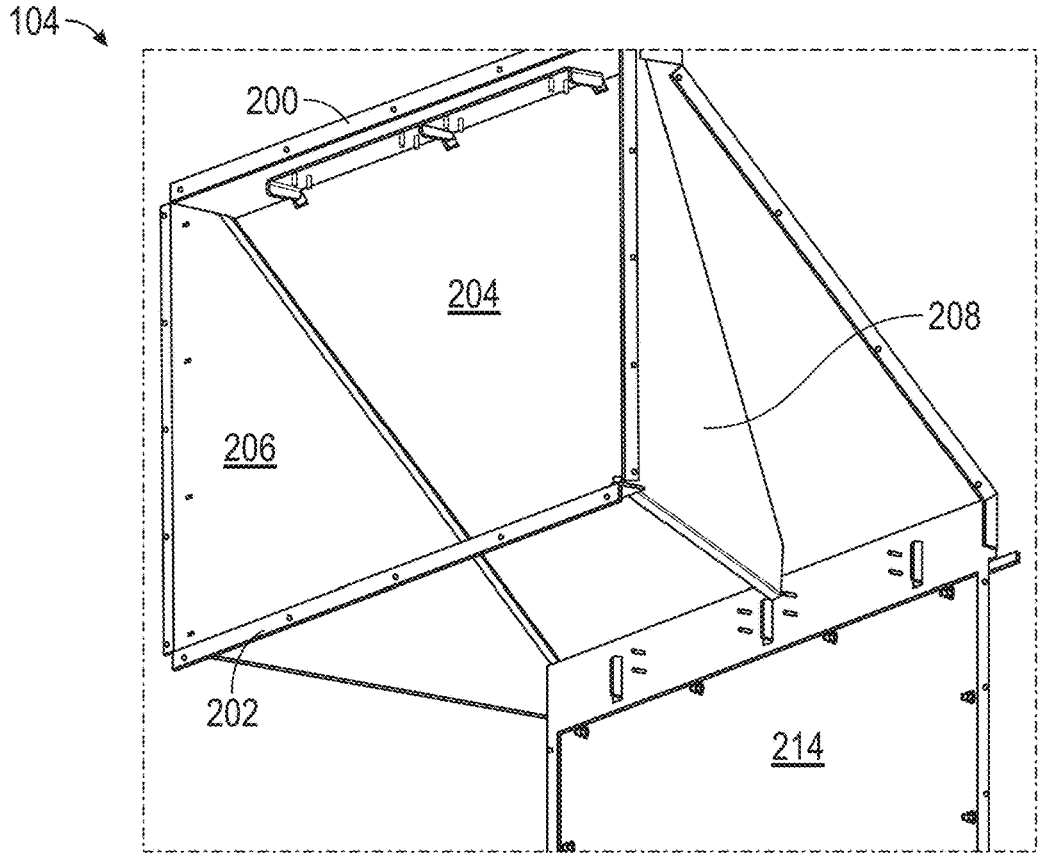
Figure 3D:
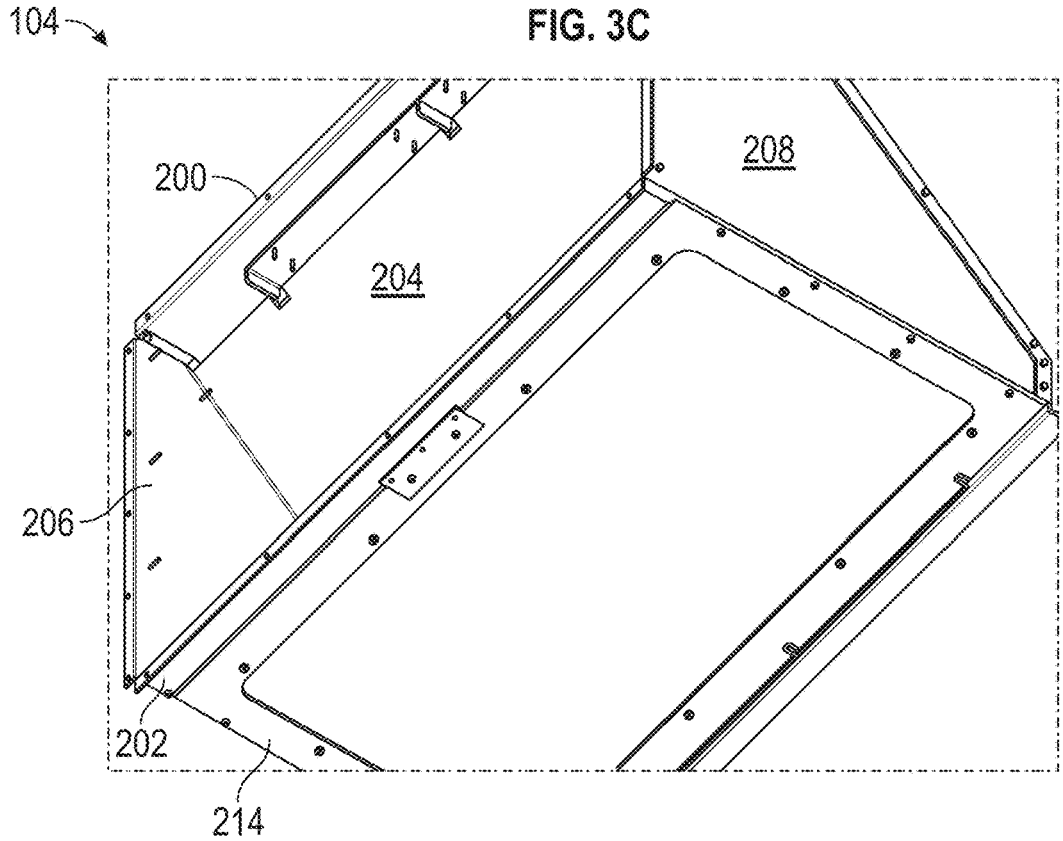

In FIG. 3B, hood plate 204 is pivoted outward and upward away from cap plate 200, base bracket 202, and side plates 206 and 208. Screen 214 is pivoted inward and downward. As shown in FIG. 3C, screen 214 is pivoted further downward to rotate more than ninety degrees from the collapsed configuration position and such that side plates 206 and 208 can be pivoted outward. As shown in FIG. 3C, side plates 206 and 208 are pivoted outward and away from cap plate 200 and base bracket 202 to mate with hood plate 204. As shown in FIG. 3D, screen 214 is pivoted upward to extend toward base bracket 202 from hood plate 204 and is connected to base bracket 202 and side plates 206 and 208. Side plates 206 and 208 are arranged outwardly/over screen 214.

Figure 4B:
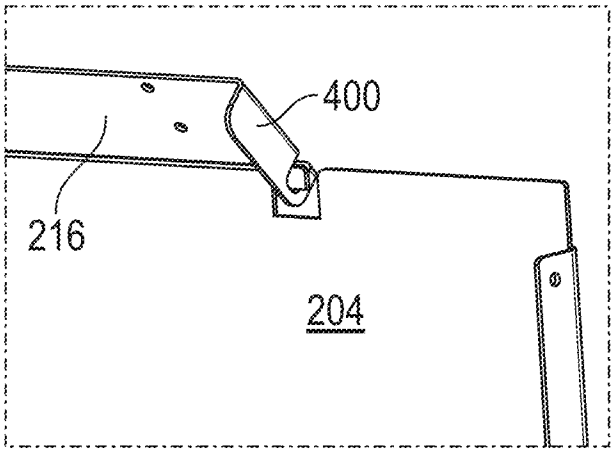
FIGS. 4A-4C are perspective views depicting an example plate hook hinge of a collapsible rain hood in accordance with this disclosure.
Figure 4A:
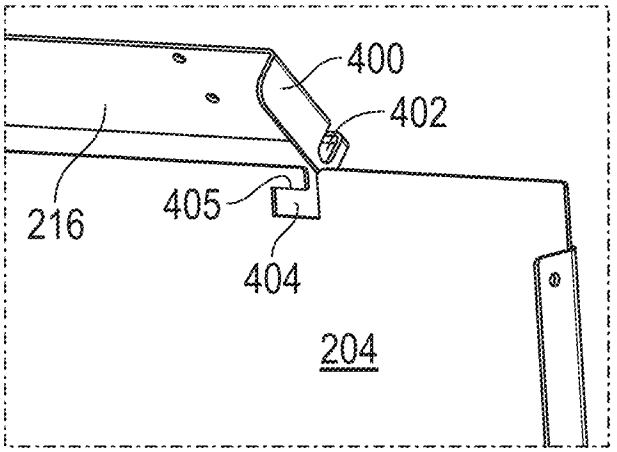
Figure 4C:
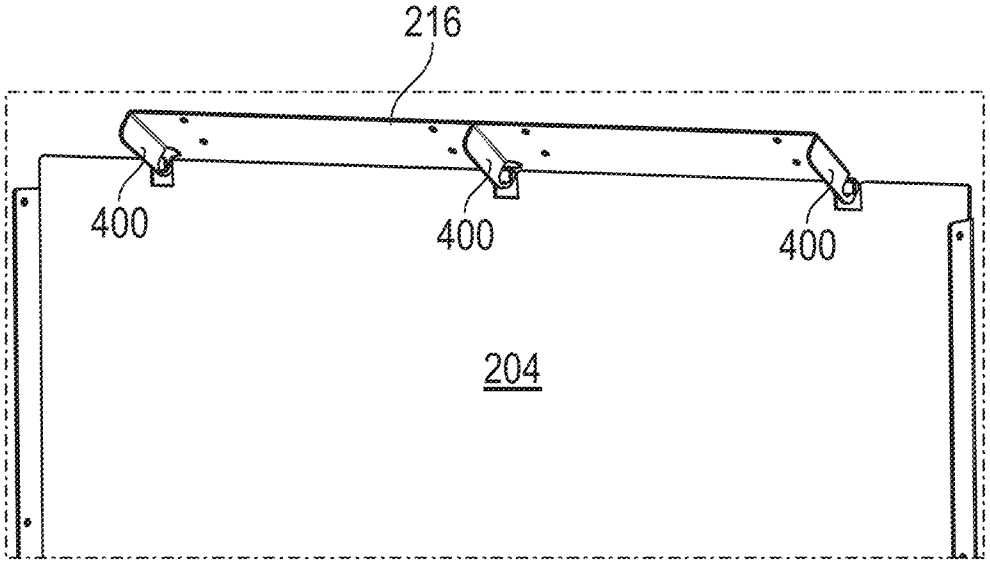

FIGS. 4A-4C depict an example plate hook hinge of collapsible rain hood 104. As noted with reference to FIGS. 2A-2B, cap plate 200 includes hinge plate 216 fixedly connected to the cap plate and hood plate 204 is pivotally connected to cap plate 200 via hinge plate 216. Referring to FIGS. 4A-4C, hinge plate 216 includes a plurality of flanges 400 extending approximately perpendicularly from hinge plate 216. Each of flanges 400 includes an aperture 402. Each aperture 402 can have different shapes including a partial loop shape and, in some examples as in the example of FIGS. 4A-4C can be in each respective flange 400 and extend into a portion of hinge plate 216 adjacent the flange. Hood plate 204 includes a plurality of apertures 404, corresponding in number to the number of apertures 402 of hinge plate 216. Each aperture 404 forms a "J" or hook shaped flange 405. As depicted in FIGS. 4B-4C, loop apertures 402 are configured to connect or hook onto J/hook shaped flanges 405 formed by apertures 404 to form a pivotal connection between hinge plate 216 (and thereby to cap plate 200) and hood plate 204.

Figure 5:
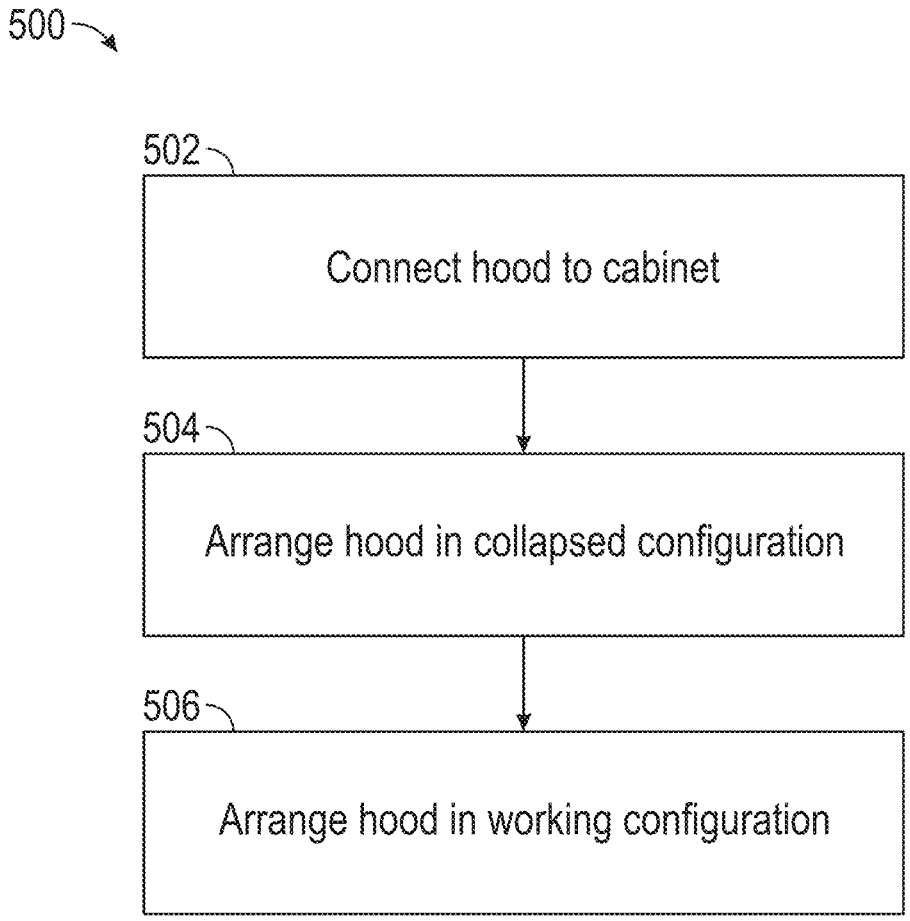
FIG. 5 is a flow chart of an example method in accordance with this disclosure.

FIG. 5 is a flow chart of example method 500 including fixedly connecting a collapsible hood to a cabinet of an air handling unit (AHU) adjacent at least one air vent in the cabinet (502), arranging the collapsible hood in a collapsed configuration in which portions of the hood are folded in a flat stacked arrangement toward the cabinet over the at least one air vent (504), and arranging the collapsible hood in a working configuration in which the portions of the hood are moved and connected to one another such that the collapsible hood is configured to inhibit ingress of materials other than air through the at least one air vent (506).

In an example, arranging collapsible hood 104 in the collapsed configuration (504) includes pivoting side plates 206 and 208 toward each other into approximately parallel alignment with cap plate 200 and base bracket 202, and pivoting hood plate 204 down toward cabinet 102 into an approximately vertical arrangement at least partially over the pair of side plates. Arranging the collapsible hood in the working configuration (506) can include pivoting hood plate 204 outward into an inclined orientation to extend down and out from cap plate 200 and pivoting each of side plates 206 and 208 outward to extend away from cap plate 200 and base bracket 202 to mate with the hood plate.

In examples, arranging the collapsible hood in the collapsed configuration can also include pivoting screen 214 up toward hood plate 204 into an approximately vertical arrangement between side plates 206 and 208 and the hood plate. Additionally, arranging the collapsible hood in the working configuration can include pivoting screen 214 downward to extend toward base bracket 200 from hood plate 204, connecting the screen to the base bracket, and pivoting side plates 206 and 208 outward to extend away from cap plate 202 and the base bracket to mate with the hood plate over the screen. And arranging the collapsible hood in the working configuration can also include connecting each of side brackets 210 and 212 to cabinet 102 and one of side plates 206 and 208.

The above description is intended to be illustrative, and not restrictive. For example, the above-described examples (or one or more aspects thereof) may be used in combination with each other. Other embodiments can be used, such as by one of ordinary skill in the art upon reviewing the above description.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

Various aspects of the disclosure have been described. These and other aspects are within the scope of the following claims.

What is claimed is:

1. An air handling unit (AHU) comprising:

a cabinet in which one or more components of the AHU are arranged and defining at least one air vent;

a collapsible hood comprising:

a cap plate fixedly connected to the cabinet above the at least one air vent;

a hinge plate fixedly connected to the cap plate;

a base bracket fixedly connected to the cabinet below the cap plate;

a hood plate pivotally connected to the hinge plate; and a pair of side plates each of which is pivotally connected to the cap plate and the base bracket, wherein:

the hinge plate comprises a loop aperture;

the hood plate comprises an aperture that defines a hook shaped flange; and the hook shaped flange of the hood plate is received in the loop aperture of the hinge plate to form the pivotal connection between the hood plate and the hinge plate.

2. The AHU of claim 1, wherein the collapsible hood is configured to be arranged in:

a working configuration in which the hood plate and the pair of side plates extend away from the cap plate and the base bracket and are configured to inhibit ingress of materials other than air through the at least one air vent; and a collapsed configuration in which the hood plate and the pair of side plates are folded in a flat stacked arrangement toward the cabinet and over the at least one air vent.

3. The AHU of claim 1, wherein the collapsible hood is configured to be arranged in:

the working configuration in which the hood plate is inclined to extend down and out from the cap plate, and each of the pair of side plates extends away from the cap plate and the base bracket to mate with the hood plate; and the collapsed configuration in which the pair of side plates are pivoted toward each other into approximately parallel alignment with the cap plate and the base bracket, the hood plate is pivoted down toward the cabinet into an approximately vertical arrangement at least partially over the pair of side plates.

4. The AHU of claim 1, further comprising a screen pivotally connected to the hood plate.

5. The AHU of claim 4, wherein the collapsible hood is configured to be arranged in:

a working configuration in which the hood plate is inclined to extend down and out from the cap plate, the screen extends toward the base bracket and the cabinet from the hood plate and is connected to the base bracket, each of the pair of side plates extends away from the cap plate and the base bracket to mate with the hood plate over the screen; and a collapsed configuration in which the pair of side plates are pivoted toward each other into approximately parallel alignment with the cap plate and the base bracket, the hood plate is pivoted down toward the cabinet into an approximately vertical arrangement, and the screen is pivoted up toward the hood plate into an approximately vertical arrangement between the pair of side plates and the hood plate.

6. The AHU of claim 1, wherein:

a first side plate of the pair of side plates is pivotally connected toward a first end of the cap plate and pivotally connected toward a first end of the base bracket; and a second side plate of the pair of side plates is pivotally connected toward a second end of the cap plate opposite the first end of the cap plate and pivotally connected toward a second end of the base bracket opposite the first end of the base bracket.

7. The AHU of claim 1, wherein each of the cap plate, the base bracket, the hood plate, and the pair of side plates comprise sheet metal.

8. The AHU of claim 1, further comprising a pair of side brackets, each of which is configured to be connected to the cabinet and one of the pair of side plates.

9. The AHU of claim 8, wherein the collapsible hood is configured to be arranged in:

the working configuration in which the hood plate is inclined to extend down and out from the cap plate, each of the pair of side plates extends away from the cap plate and the base bracket to mate with the hood plate, and each of the side brackets is connected to the cabinet and toward an edge of one of the side plates adjacent the cabinet.

* * * * *